US007133825B2

(12) United States Patent
Bou-Ghazale

(10) Patent No.: US 7,133,825 B2
(45) Date of Patent: Nov. 7, 2006

(54) COMPUTATIONALLY EFFICIENT BACKGROUND NOISE SUPPRESSOR FOR SPEECH CODING AND SPEECH RECOGNITION

(75) Inventor: Sahar E. Bou-Ghazale, Irvine, CA (US)

(73) Assignee: Skyworks Solutions, Inc., Irvine, CA (US)

( * ) Notice: Subject to any disclaimer, the term of this patent is extended or adjusted under 35 U.S.C. 154(b) by 440 days.

(21) Appl. No.: 10/724,430

(22) Filed: Nov. 28, 2003

(65) Prior Publication Data

US 2005/0119882 A1 Jun. 2, 2005

(51) Int. Cl.
*G10L 21/02* (2006.01)

(52) U.S. Cl. ..... 704/233; 704/226

(58) Field of Classification Search ..... 704/226, 704/233

See application file for complete search history.

(56) References Cited

U.S. PATENT DOCUMENTS 4,630,305 A * 12/1986 Borth et al. ..... 381/94.3
4,811,404 A * 3/1989 Vilmur et al. ..... 381/94.3
5,839,101 A * 11/1998 Vahatalo et al. ..... 704/226
6,023,674 A * 2/2000 Mekuria ..... 704/233
6,324,502 B1 * 11/2001 Handel et al. ..... 704/226

* cited by examiner

*Primary Examiner*—Daniel Abebe
(74) *Attorney, Agent, or Firm*—Farjami & Farjami LLP

(57) ABSTRACT

A noise suppressor for suppressing noise in a source speech signal, where a method utilized by the noise suppressor comprises calculating a signal-to-noise ratio in the source speech signal, calculating a background noise estimate for a current frame of the source speech signal based on said current frame and at least one previous frame and in accordance with the signal-to-noise ratio, wherein the calculating the signal-to-noise ratio is carried out independent from the background noise estimate for the current frame, and subtracting the background noise estimate from the source speech signal to produce a noise-reduced speech signal. The method may also comprise calculating an over-subtraction parameter based on the signal-to-noise ratio, calculating a noise-floor parameter based on the signal-to-noise ratio, wherein the subtracting uses the over-subtraction parameter and the noise-floor parameter to produce the noise-reduced speech signal.

39 Claims, 3 Drawing Sheets

COMPUTATIONALLY EFFICIENT BACKGROUND NOISE SUPPRESSOR FOR SPEECH CODING AND SPEECH RECOGNITION

BACKGROUND OF THE INVENTION

1. Field of the Invention

The present invention is generally in the field of speech processing. More specifically, the invention is in the field of noise suppression for speech coding and speech recognition.

2. Related Art

Presently there are a number of approaches for reducing background noise (also referred to as "noise suppression") from a source signal. As is known in the art, noise suppression is an important feature for improving the performance of speech coding and/or speech recognition systems. Noise suppression offers a number of benefits, including suppressing the background noise so that the party at the receiving side can hear the caller better, improving speech intelligibility, improving echo cancellation performance, and improving performance of automatic speech recognition ("ASR"), among others.

Spectral subtraction is a known method for noise suppression, and is based on the assumption that a source signal, x(t), is composed of a clean speech signal, s(t), in addition to a noise signal, n(t), that is stationary and uncorrelated with the clean speech signal, as given by:

$$x(t)=s(t)+n(t) \quad \text{(Equation 1).}$$

The noise subtraction is processed in the frequency domain using the short-time Fourier transform. It is assumed that the noise signal is estimated from a signal portion consisting of pure noise. Then, the short time clean speech spectrum, $|\hat{S}(m,k)|$, can be estimated by subtracting the short-time noise estimate, $|\hat{N}(m,k)|$, from the short-time noisy speech spectrum, $|X(m,k)|$, as given by:

$$|\hat{S}(m,k)|=|X(m,k)|-|\hat{N}(m,k)| \quad \text{(Equation 2).}$$

The noise-reduced speech signal, $\hat{S}(m,k)$, is then re-synthesized using the original phase spectrum of the source signal. This simple form of spectral subtraction produces undesired signal distortions, such as "running water" effect and "musical noise," if the noise estimate is either too low or too high. It is possible to eliminate the musical noise by subtracting more than the average noise spectrum. This leads to the Generalized Spectral Subtraction ("GSS") method, which is given by:

$$|\hat{S}(m,k)|=X(m,k)|-\alpha|\hat{N}(m,k)| \quad \text{(Equation 3).}$$

In addition, to avoid negative estimates of speech, the negative magnitudes are sometimes replaced by zeros or by a spectral as given by:

$$|\hat{S}(m,k)|=\max(|X(m,k)|-\alpha|\hat{N}(m,k)|,\beta|X(m,k)|) \quad \text{(Equation 4).}$$

It is possible to suppress unwanted noise effectively with GSS by using a very large value for $\alpha$; however, the speech sounds will be muffled and intelligibility will be lost. Accordingly, there exists a strong need in the art for a computationally efficient background noise suppressor for speech coding and speech recognition, which suppresses unwanted noise effectively while maintaining reasonable high intelligibility.

SUMMARY OF THE INVENTION

The present invention is directed to a computationally efficient background noise suppression method and system for speech coding and speech recognition. The invention overcomes the need in the art for an efficient and accurate noise suppressor that suppresses unwanted noise effectively while maintaining reasonable high intelligibility.

In one aspect, a method for suppressing noise in a source speech signal comprises calculating a signal-to-noise ratio in the source speech signal, calculating a background noise estimate for a current frame of the source speech signal based on said current frame and at least one previous frame and in accordance with the signal-to-noise ratio, wherein calculating the signal-to-noise ratio is carried out independent from the background noise estimate for the current frame. The noise suppression method further comprises subtracting the background noise estimate from the source speech signal to produce a noise-reduced speech signal.

In a further aspect, the noise suppression method further comprises updating the background noise estimate at a faster rate for noise regions than for speech regions. In such aspect, the noise regions and the speech regions may be identified and/or distinguished based on the signal-to-noise ratio.

In yet another aspect, the noise suppression method further comprises calculating an over-subtraction parameter based on the signal-to-noise ratio, wherein the over-subtraction parameter is configured to reduce distortion in noise-free signal. According to this particular embodiment, the over-subtraction parameter can be as low as zero.

Also, in one aspect, the noise suppression method further comprises calculating a noise-floor parameter based on the signal-to-noise ratio, wherein the noise-floor parameter is configured to reduce noise fluctuations, level of background noise and musical noise.

According to other aspects, systems, devices and computer software products or media for noise suppression in accordance with the above technique are provided.

According to various embodiments of the present invention, the background noise suppressor of the present invention provides a significantly improved estimate of the background noise present in the source signal for producing a significantly improved noise-reduced signal, thereby overcoming a number of disadvantages in a computationally efficient manner. Other features and advantages of the present invention will become more readily apparent to those of ordinary skill in the art after reviewing the following detailed description and accompanying drawings.

DETAILED DESCRIPTION OF THE INVENTION

The present invention is directed to a computationally efficient background noise suppression method for speech coding and speech recognition. The following description contains specific information pertaining to the implementation of the present invention. One skilled in the art will recognize that the present invention may be implemented in a manner different from that specifically discussed in the present application. Moreover, some of the specific details of the invention are not discussed in order to not obscure the invention. The specific details not described in the present application are within the knowledge of a person of ordinary skill in the art.

The drawings in the present application and their accompanying detailed description are directed to merely exemplary embodiments of the invention. To maintain brevity, other embodiments of the invention which use the principles of the present invention are not specifically described in the present application and are not specifically illustrated by the present drawings.

Figure 1:
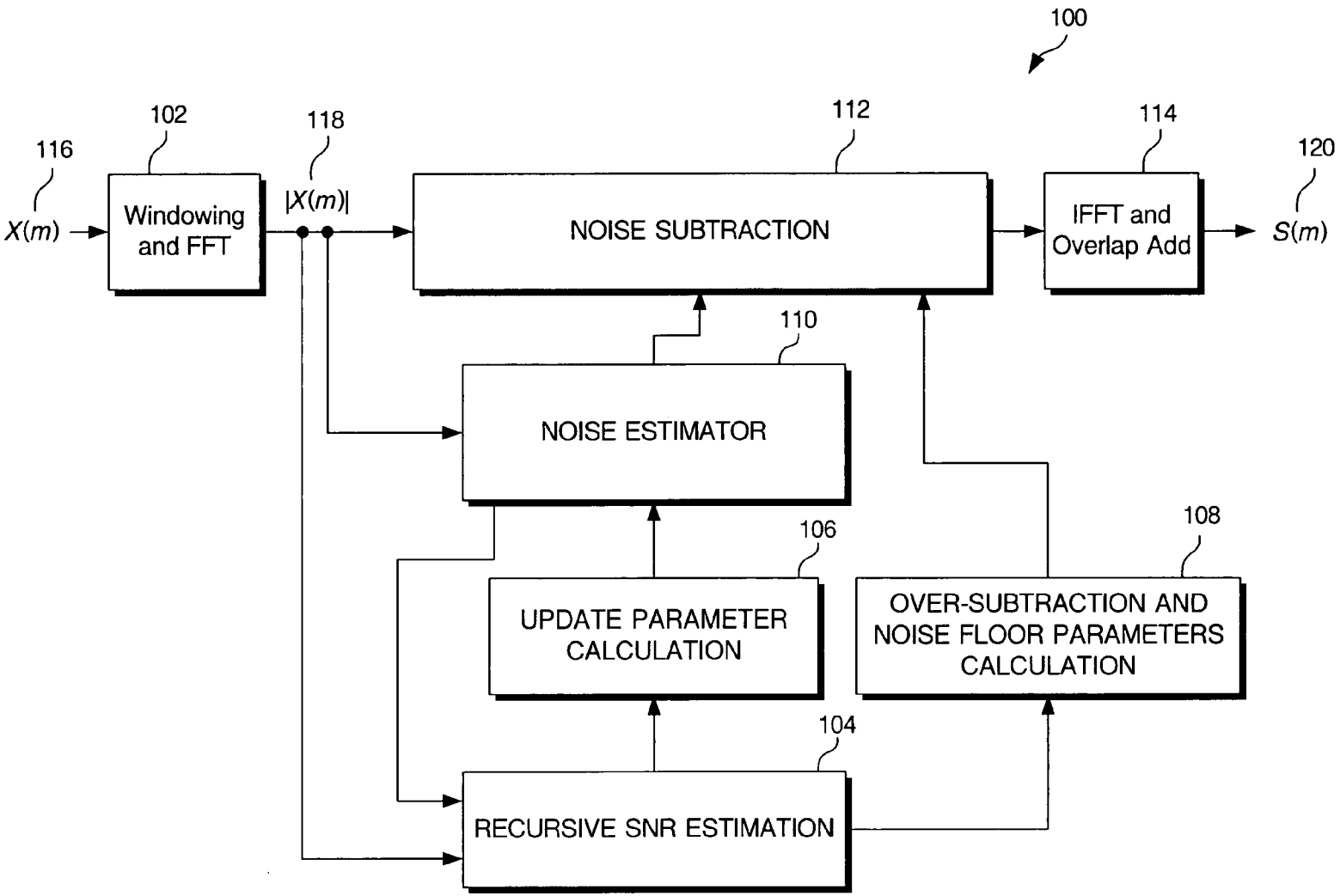
FIG. 1 shows a flow/block diagram depicting a background noise suppressor according to one embodiment of the present invention.

Referring to FIG. 1, there is shown flow/block diagram 100 illustrating an exemplary background noise suppressor method and system according to one embodiment of the present invention. Certain details and features have been left out of flow/block diagram 100 of FIG. 1 that are apparent to a person of ordinary skill in the art. For example, a step or element may include one or more sub-steps or sub-elements, as known in the art. While steps or elements 102 through 114 shown in flow/block diagram 100 are sufficient to describe one embodiment of the present invention, other embodiments of the invention may utilize steps or elements different from those shown in flow/block diagram 100.

As described below, the method depicted by flow/block diagram 100 may be utilized in a number of applications where reduction and/or suppression of background noise present in a source signal are desired. For example, the background noise suppression method of the present invention is suitable for use with speech coding and speech recognition. Also, as described below, the method depicted by flow/block diagram 100 overcomes a number of disadvantages associated with conventional noise suppression techniques in a computationally efficient manner.

By way of example, the method depicted by flow/block diagram 100 may be embodied in a software medium for execution by a processor operating in a phone device, such as a mobile phone device, for reducing and/or suppression background noise present in a source signal ("X(m)") 116 for producing a noise-reduced signal ("S(m)") 120.

At step or element 102, source signal X(m) 116 is transformed into the frequency domain. According to one embodiment of the present invention, source signal X(m) 116 is assumed to have a sampling rate of 8 kilohertz ("kHz") and is processed in 16 milliseconds ("ms") frames with overlap, such as 50% overlap, for example. Source signal X(m) 116 is transformed into the frequency domain by applying a Hamming window to a frame of 128 samples followed by computing a 128-point Fast Fourier Transform ("FFT") for producing signal |X(m)| 118. By taking advantage of the frequency domain symmetry of a real signal, 65-points in signal |X(m)| 118 are sufficient to represent the 128-point FFT. Signal |X(m)| 118 is then fed to recursive signal-to-noise ratio ("SNR") estimation step or element 104, noise estimation step or element 110 and noise subtraction step or element 112.

At step or element 104, a recursive SNR of source signal X(m) 116 is estimated employing a recursive SNR computation that accounts for information from previous frames and is independent of the noise estimation for the current frame, and is given by:

$$SNR(m,k) = (1-\eta)\max\left(\frac{|X(m,k)|^2 - |\hat{N}(m-1,k)|^2}{|\hat{N}(m-1,k)|^2}, 0\right) + \eta\frac{|X(m-1,k)|^2 - |\hat{N}(m-2,k)|^2}{|\hat{N}(m-1,k)|^2} \quad \text{(Equation 5)}$$

where smoothing parameter η controls the amount of time averaging applied to the SNR estimates. In contrast to a prior SNR computation given by:

$$SNR_{prior}(m,k) = (1-\eta)\max\left(\frac{|X(m,k)|^2 - |N(m,k)|^2}{|N(m,k)|^2}, 0\right) + \eta\frac{|\hat{S}(m-1,k)|^2}{|\hat{N}(m-1,k)|^2}, \quad \text{(Equation 6)}$$

$$0.9 \le \eta \le 0.98$$

the SNR computation according to Equation 5 is not dependent on the noise estimate of the current frame, $|N(m,k)|^2$, nor on the enhanced or noise-reduced signal from the previous frame, $|\hat{S}(m-1,k)|$ which, in turn, is a function of a plurality of subtraction parameters, including over-subtraction parameter ("α") and noise floor parameter ("β") of the current frame, as is required by the prior SNR computation according to Equation 6. Instead, the exemplary SNR computation given by Equation 5 is based on the noise estimate from the previous two frames and the original source signal of the current and previous frame, and is not dependent on the values of the subtraction parameters α and β of the current frame. Therefore, the recursive SNR estimation carried out during step or element 104 is independent of the noise estimate for the current frame.

As shown in FIG. 1, the SNR estimated during step or element 104 is used to determine the value of noise update parameter ("γ") during step or element 106, and the values of over-subtraction parameter α and noise floor parameter β during step or element 108.

At step or element 106, noise update parameter γ which controls the rate at which the noise estimate is adapted during step or element 110, is updated at different rates, i.e., using different values, for speech regions and for noise regions based on the SNR estimate calculated during step or element 104. When noise update parameter γ is close to 1, the rate of adaptation is slow. If noise update parameter γ equals 1, then there is no noise adaptation at all. If γ<0.5, then rate of noise adaptation is considered to be very fast. According to one embodiment of the present invention, noise update parameter γ assumes one of two values and is adapted for each frame based on the average SNR of the current frame such that the noise estimate is updated at a faster rate for noise regions than for speech regions, as discussed below.

Calculating noise update parameter γ in this manner takes into account that most noisy environments are non-stationary, and while it is desirable to update the noise estimate as often as possible in order to adapt to varying noise levels and characteristics, if the noise estimate is updated during noise-only regions, then the algorithm cannot adapt quickly to sudden changes in background noise levels such as moving from a quiet to a noisy environment and vice versa. On the other hand, if the noise estimate is updated continuously, then the noise estimate begins to converge towards speech during speech regions, which can lead to removing or smearing speech information. By employing different noise estimate update rates for noise regions and speech regions, the noise estimate calculation technique according to the present invention provides an efficient approach for continuously and accurately updating the noise estimate without smearing the speech content or introducing annoying musical tone.

As discussed above, the noise estimate is continuously updated with every new frame during both speech and non-speech regions at two different rates based on the average SNR estimate across the different frequencies. Another advantage to this approach is that the algorithm does not require explicit speech/non-speech classification in order to properly update the noise estimate. Instead, speech and non-speech regions are distinguished based on the average SNR estimate across all frequencies of the current frame. Accordingly, costly and erroneous speech/non-speech classification in noisy environments is avoided, and computation efficiency is significantly improved.

At step or element 108, over-subtraction parameter $\alpha$ and noise floor parameter $\beta$ are calculated based on the SNR estimate calculated during step or element 104. Over-subtraction parameter $\alpha$ is responsible for reducing the residual noise peaks or musical noise and distortion in noise-free signal. According to the present invention, the value of over-subtraction parameter $\alpha$ is set in order to prevent both musical noise and too much signal distortion. Thus, the value of over-subtraction parameter $\alpha$ should be just large enough to attenuate the unwanted noise. For example, while using a very large over-subtraction parameter $\alpha$ could fully attenuate the unwanted noise and suppress musical noise generated in the noise subtraction process, a very large over-subtraction parameter $\alpha$ weakens the speech content and reduces speech intelligibility.

Figure 2:
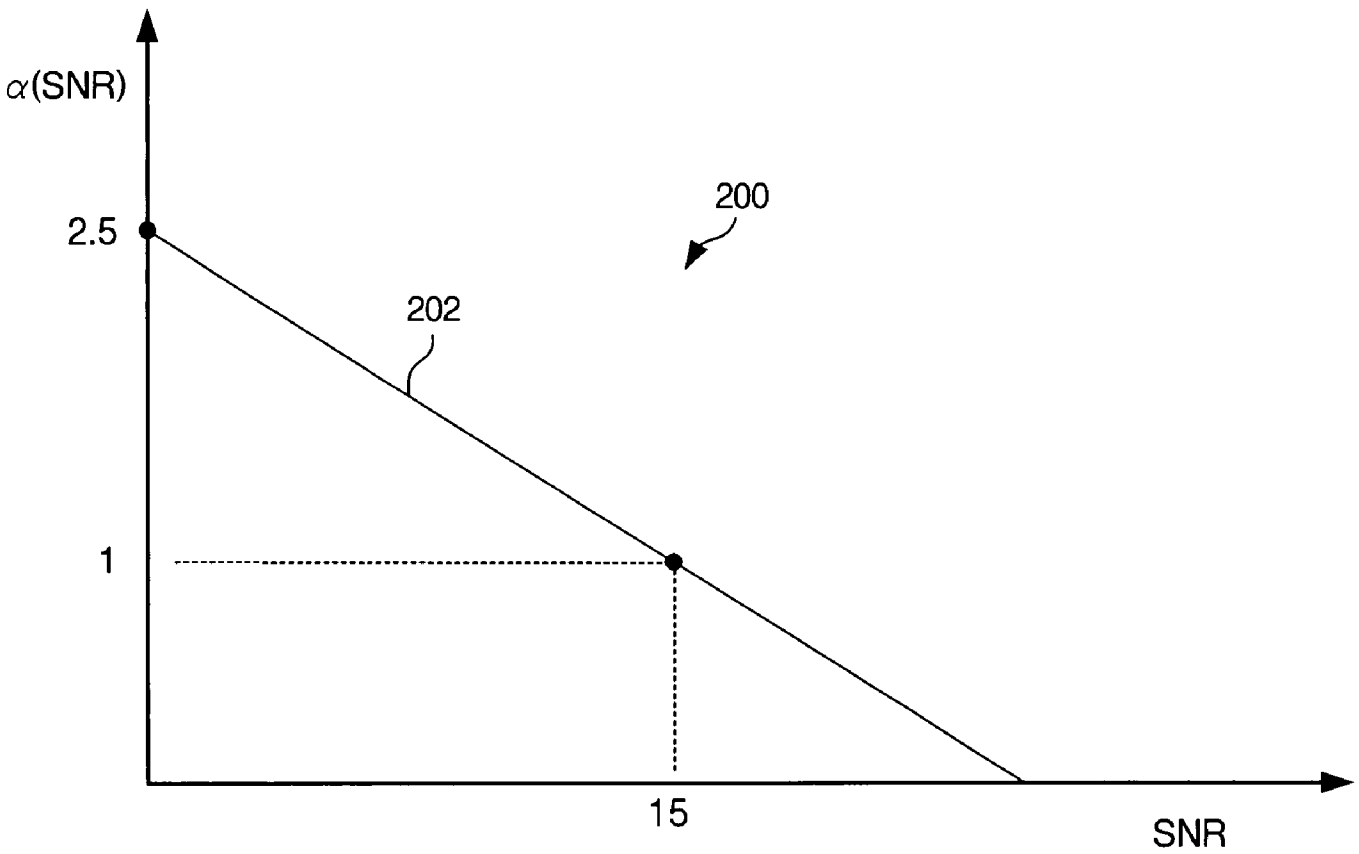
FIG. 2 shows a graph depicting the over-subtraction parameter as a function of the signal-to-noise ratio in accordance with one embodiment of the present invention.

Conventionally, the smallest value assigned to over-subtraction parameter $\alpha$ is one (1), indicating that a noise estimate is subtracted from noisy speech. However, in accordance with the present invention, the value of over-subtraction parameter $\alpha$ can take values as small as zero (0), indicating that in a very clean speech region, no noise estimate is subtracted from the original speech. Such an approach advantageously preserves the original signal amplitude, and reduces distortions in clean speech regions. According to one embodiment of the present invention, over-subtraction parameter $\alpha$ is adapted for each frame m and each frequency bin k based on the SNR of the current frame as depicted in graph 200 of FIG. 2. In FIG. 2, line 202 is defined by the following equation:

$$\alpha(SNR)=\alpha_0+SNR*(1-\alpha_0)/SNR_1 \quad \text{(Equation 7).}$$

As shown in FIG. 2, the value of over-subtraction parameter $\alpha$, defined by the vertical axis, can be less than 1, for very clean speech regions, such as when SNR, defined by the horizontal axis, is greater than 15, for example.

Noise floor parameter $\beta$ (also referred to as "spectral flooring parameter") controls the amount of noise fluctuation, level of background noise and musical noise in the processed signal. An increased noise floor parameter $\beta$ value reduces the perceived noise fluctuation but increases the level of background noise. In accordance with the present invention, noise floor parameter $\beta$ is varied according to the SNR. For high levels of background noise, a lower noise floor parameters is used, and for less noisy signals, a higher noise floor parameter $\beta$ is used. Such an approach is a significant departure from prior techniques wherein a fixed noise floor or comfort noise is applied to the noise-reduced signal. Advantageously, the problem of high residual noise and/or increased background noise associated with a fixed noise floor is avoided by noise floor parameter $\beta$ calculation technique of the present invention wherein noise floor parameter $\beta$ varies according to the SNR.

Figure 3:
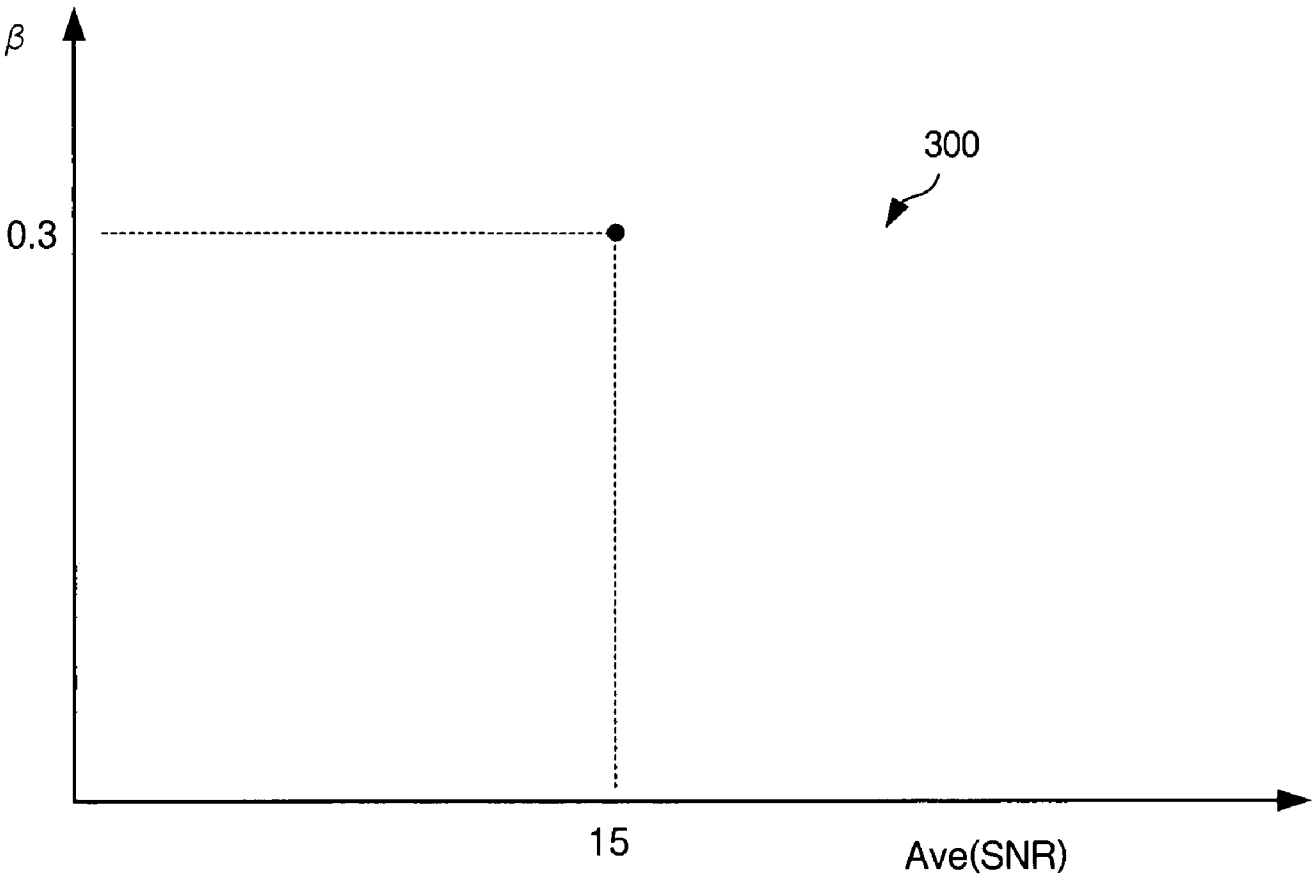
FIG. 3 shows a graph depicting the noise floor parameter as a function of the average signal-to-noise ratio in accordance with one embodiment of the present invention.

According to one embodiment of the present invention, noise floor parameter $\beta$ is adapted for each frame m based on the average SNR across all 65-frequency bins of the current frame as illustrated in graph 300 in FIG. 3. In FIG. 3, noise floor parameter $\beta$, defined by the vertical axis, is a function of the average SNR, defined by the horizontal axis, and is defined by the following equation:

$$\beta(SNR)=\beta_0+Ave(SNR)*(1-\beta_0)/SNR_1 \quad \text{(Equation 8).}$$

As shown in FIG. 3, exemplary average (SNR) of 15 corresponds to noise floor parameter $\beta$ of 0.3.

At step or element 110, a noise estimate (also referred to as "noise spectrum" estimate) for the current frame is calculated based on signal $|X(m)|$ 118 and noise update parameter $\gamma$ calculated during step or element 106. As noted above, the noise estimate is generally based on the current frame and one or more previous frames. According to one embodiment of the present invention, upon initialization of noise suppression, an initial noise spectrum estimate is computed from the first 40 ms of source signal X(m) 116 with the assumption that the first 4 frames of the speech signal comprise noise-only frames. The noise spectrum is estimated across 65 frequency bins from the actual FFT magnitude spectrum rather than a smoothed spectrum. In the event that the initial samples of data include speech contaminated with noise instead of pure noise, the algorithm quickly recovers to the correct noise estimate since the noise estimate is updated every 10 ms.

As discussed above, when adapting the noise estimate, the noise estimate is updated at a faster rate during non-speech regions and at a slower rate during speech regions, and is given by:

$$|\hat{N}(m,k)|=(1-\gamma_{SNR})|X(m,k)|+\gamma_{SNR}|\hat{N}(m-1,k)| \quad \text{(Equation 9).}$$

According to one embodiment of the present invention, noise update parameter $\gamma$ assumes one of two values and is adapted for each frame based on the average SNR of the current frame. By way of example, if the frame is considered to contain speech, then the noise estimate is slowly updated with the current frame consisting of speech, and $\gamma$ is set to 0.999. If the frame is considered to be noise, then the noise estimate is more quickly updated, and $\gamma$ is set to 0.8.

At step or element 112, noise subtraction (also referred to as "spectral subtraction") is carried out employing signal $|X(m)|$ 118, noise estimation ($|\hat{N}(m,k)|$) calculated during step or element 110, over-subtraction parameter $\alpha$ and noise floor parameter $\beta$ calculated during step or element 108 for producing noise-reduced signal $|\hat{S}(m,k)|$. Noise-reduced signal is given by:

$$|\hat{S}(m,k)|=\max(|X(m,k)|-\alpha(m,k)|\hat{N}(m,k)|,\ \beta(m)|X(m,k)|) \quad \text{(Equation 10).}$$

If over-subtraction causes the magnitudes at certain frequencies to go below noise floor parameter $\beta$, then noise floor parameter $\beta$ will replace the magnitudes at those frequencies. Furthermore, to avoid distorting the clean speech signal and to preserve its quality, a noise estimate is not subtracted from source signal $|X(m)|$ 118 when high-SNR regions are detected, as discussed above. Therefore, the smallest value for over-subtraction parameter $\alpha$ is zero.

At step or element 114, noise-reduced signal $|\hat{S}(m, k)|$ is converted back to the time-domain via Inverse FFT ("IFFT") and overlap-add to reconstruct the noise-reduced signal S(m) 120.

The background noise suppressor of the present invention provides a significantly improved estimate of the background noise present in the source signal for producing a significantly improved noise-reduced signal, thereby overcoming a number of disadvantages in a computationally efficient manner. As discussed above, the background noise suppressor of the present invention adapts to quickly varying noise characteristics, improves SNR, preserves quality of clean speech, and improves performance of speech recognition in noisy environments. Moreover, the background noise suppressor of the present invention does not smear the speech content, introduce musical tones, or introduce "running water" effect.

From the above description of exemplary embodiments of the invention it is manifest that various techniques can be used for implementing the concepts of the present invention without departing from its scope. Moreover, while the invention has been described with specific reference to certain embodiments, a person of ordinary skill in the art would recognize that changes could be made in form and detail without departing from the spirit and the scope of the invention. For example, it is manifest that the size of the frames, the number of samples, and the noise estimation update rates may vary from the values provided in the exemplary embodiments described above. The described exemplary embodiments are to be considered in all respects as illustrative and not restrictive. It should also be understood that the invention is not limited to the particular exemplary embodiments described herein, but is capable of many rearrangements, modifications, and substitutions without departing from the scope of the invention.

Thus, a computationally efficient background noise suppressor for speech coding and speech recognition has been described.

What is claimed is:

1. A method for suppressing noise in a source speech signal, said method comprising:

calculating a signal-to-noise ratio in said source speech signal;

calculating a background noise estimate for a current frame of said source speech signal based on said current frame and at least one previous frame and in accordance with said signal-to-noise ratio, wherein said calculating said signal-to-noise ratio is carried out independent from said background noise estimate for said current frame;

calculating an over-subtraction parameter based on said signal-to-noise ratio;

calculating a noise-floor parameter based on said signal-to-noise ratio; and subtracting said background noise estimate from said source speech signal based on said over-subtraction parameter and said noise-floor parameter to produce a noise-reduced speech signal.

2. The method of claim 1 further comprising: updating said background noise estimate at a faster rate for noise regions than for speech regions.

3. The method of claim 2, wherein said noise regions and said speech regions are identified based on said signal-to-noise ratio.

4. The method of claim 1, wherein said over-subtraction parameter is configured to reduce distortion in noise-free signal.

5. The method of claim 4, wherein said over-subtraction parameter is about zero.

6. The method of claim 1, wherein said noise-floor parameter is configured to control noise fluctuations, level of background noise and musical noise.

7. A noise suppressor for suppressing noise in a source speech signal, said noise suppressor comprising:

a first element configured to calculate a signal-to-noise ratio in said source speech signal;

a second element configured to calculate a background noise estimate for a current frame of said source speech signal based on said current frame and at least one previous frame and in accordance with said signal-to-noise ratio, wherein said first element calculates said signal-to-noise ratio independent from said background noise estimate for said current frame;

a third element configured to calculate an over-subtraction parameter based on said signal-to-noise ratio;

a fourth element configured to calculate a noise-floor parameter based on said signal-to-noise ratio; and a fifth element configured to subtract said background noise estimate from said source speech signal based on said over-subtraction parameter and said noise-floor parameter to produce a noise-reduced speech signal.

8. The noise suppressor of claim 7, wherein said background noise estimate is updated at a faster rate for noise regions than for speech regions.

9. The noise suppressor of claim 8, wherein said noise regions and said speech regions are identified based on said signal-to-noise ratio.

10. The noise suppressor of claim 7, wherein said over-subtraction parameter is configured to reduce distortion in noise-free signal.

11. The noise suppressor of claim 10, wherein said over-subtraction parameter is about zero.

12. The noise suppressor of claim 7, wherein said noise-floor parameter is configured to reduce noise fluctuations, level of background noise and musical noise.

13. A computer software program stored in a computer medium for execution by a processor to suppress noise in a source speech signal, said computer software program comprising:

code for calculating a signal-to-noise ratio in said source speech signal;

code for calculating a background noise estimate for a current frame of said source speech signal based on said current frame and at least one previous frame and in accordance with said signal-to-noise ratio, wherein said code for calculating said signal-to-noise ratio is carried out independent from said background noise estimate for said current frame;

code for calculating an over-subtraction parameter based on said signal-to-noise ratio;

code for calculating a noise-floor parameter based on said signal-to-noise ratio; and code for subtracting said background noise estimate from said source speech signal based on said over-subtraction parameter and said noise-floor parameter to produce a noise-reduced speech signal.

14. The computer software program of claim 13 further comprising: code for updating said background noise estimate at a faster rate for noise regions than for speech regions.

15. The computer software program of claim 14, wherein said noise regions and said speech regions are identified based on said signal-to-noise ratio.

16. The computer software program of claim 13, wherein said over-subtraction parameter is configured to reduce distortion in noise-free signal.

17. The computer software program of claim 16, wherein said over-subtraction parameter is about zero.

18. The computer software program of claim 13, wherein said noise-floor parameter is configured to reduce noise fluctuations, level of background noise and musical noise.

19. A method for suppressing noise in a source speech signal, said method comprising:

calculating a signal-to-noise ratio in said source speech signal;

calculating a background noise estimate for a current frame of said source speech signal based on said current frame and at least one previous frame and in accordance with said signal-to-noise ratio, wherein said calculating said signal-to-noise ratio is carried out independent from said background noise estimate for said current frame; and calculating an over-subtraction parameter based on said signal-to-noise ratio:

subtracting said background noise estimate from said source speech signal based on said over-subtraction parameter to produce a noise-reduced speech signal.

20. The method of claim 19 further comprising: updating said background noise estimate at a faster rate for noise regions than for speech regions.

21. The method of claim 20, wherein said noise regions and said speech regions are identified based on said signal-to-noise ratio.

22. The method of claim 19, wherein said over-subtraction parameter is configured to reduce distortion in noise-free signal.

23. The method of claim 19, wherein said over-subtraction parameter is less than one.

24. The method of claim 19 further comprising: calculating a noise-floor parameter based on said signal-to-noise ratio.

25. The method of claim 24, wherein said noise-floor parameter is configured to reduce noise fluctuations, level of background noise and musical noise.

26. A noise suppressor for suppressing noise in a source speech signal, said noise suppressor comprising:

a first element configured to calculate a signal-to-noise ratio in said source speech signal;

a second element configured to calculate a background noise estimate for a current frame of said source speech signal based on said current frame and at least one previous frame and in accordance with said signal-to-noise ratio, wherein said first element calculates said signal-to-noise ratio independent from said background noise estimate for said current frame;

a third element configured to calculate an over-subtraction parameter based on said signal-to-noise ratio;

a fourth element configured to subtract said background noise estimate from said source speech signal based on said over-subtraction parameter to produce a noise-reduced speech signal.

27. The noise suppressor of claim 26, wherein said background noise estimate is updated at a faster rate for noise regions than for speech regions.

28. The noise suppressor of claim 27, wherein said noise regions and said speech regions are identified based on said signal-to-noise ratio.

29. The noise suppressor of claim 26, wherein said over-subtraction parameter is configured to reduce distortion in noise-free signal.

30. The noise suppressor of claim 26, wherein said over-subtraction parameter is less than one.

31. The noise suppressor of claim 26 further comprising: a fifth element configured to calculate a noise-floor parameter based on said signal-to-noise ratio for use by said fourth element.

32. The noise suppressor of claim 31, wherein said noise-floor parameter is configured to reduce noise fluctuations, level of background noise and musical noise.

33. A computer software program stored in a computer medium for execution by a processor to suppress noise in a source speech signal, said computer software program comprising:

code for calculating a signal-to-noise ratio in said source speech signal;

code for calculating a background noise estimate for a current frame of said source speech signal based on said current frame and at least one previous frame and in accordance with said signal-to-noise ratio, wherein said code for calculating said signal-to-noise ratio is carried out independent from said background noise estimate for said current frame;

code for calculating an over-subtraction parameter based on said signal-to-noise ratio; and code for subtracting said background noise estimate from said source speech signal based on said over-subtraction parameter to produce a noise-reduced speech signal.

34. The computer software program of claim 33 further comprising: code for updating said background noise estimate at a faster rate for noise regions than for speech regions.

35. The computer software program of claim 34, wherein said noise regions and said speech regions are identified based on said signal-to-noise ratio.

36. The computer software program of claim 33, wherein said over-subtraction parameter is configured to reduce distortion in noise-free signal.

37. The computer software program of claim 33, wherein said over-subtraction parameter is less than one.

38. The computer software program of claim 33 further comprising: code for calculating a noise-floor parameter based on said signal-to-noise ratio.

39. The computer software program of claim 38, wherein said noise-floor parameter is configured to reduce noise fluctuations, level of background noise and musical noise.

* * * * *